United States Patent [19]

Brenneman

[11] 4,174,473

[45] Nov. 13, 1979

[54] SAFETY SWITCH FOR FLOOR TREATMENT APPARATUS

[75] Inventor: Allen Brenneman, Elkhart, Ind.

[73] Assignee: Aktiebolaget Electrolux, Stockholm, Sweden

[21] Appl. No.: 902,803

[22] Filed: May 4, 1978

[51] Int. Cl.[2] ..... H01H 9/06; H01H 13/08; H01H 9/20; H01H 3/20

[52] U.S. Cl. ..... 200/157; 15/DIG. 10; 200/61.85; 200/325

[58] Field of Search ..... 200/321, 327, 61.85, 200/334, 335, 153 T, 157, 52 R, 322, 325; 15/49 R, DIG. 10

[56] References Cited

U.S. PATENT DOCUMENTS

| | | | |
|---|---|---|---|
| 2,630,509 | 3/1953 | Arones | 200/157 |
| 2,919,332 | 12/1959 | Descarries | 200/157 |
| 3,397,419 | 8/1968 | Okun | 15/49 R |
| 3,766,352 | 10/1973 | Bigley | 200/325 |

*Primary Examiner*—Steven L. Stephan
*Attorney, Agent, or Firm*—Alfred E. Miller

[57] ABSTRACT

A safety switch for a floor treatment machine, such as a commercial type floor polishing apparatus. The switch is incorporated in an existing control housing of the apparatus and has a trigger mechanism for operating a microswitch to turn the apparatus on or off. The safety switch must be manually moved to permit the trigger to release the negative pressure microswitch. The microswitch reverts to an off position when the spring-loaded mechanism is released.

5 Claims, 4 Drawing Figures

Fig. 2.
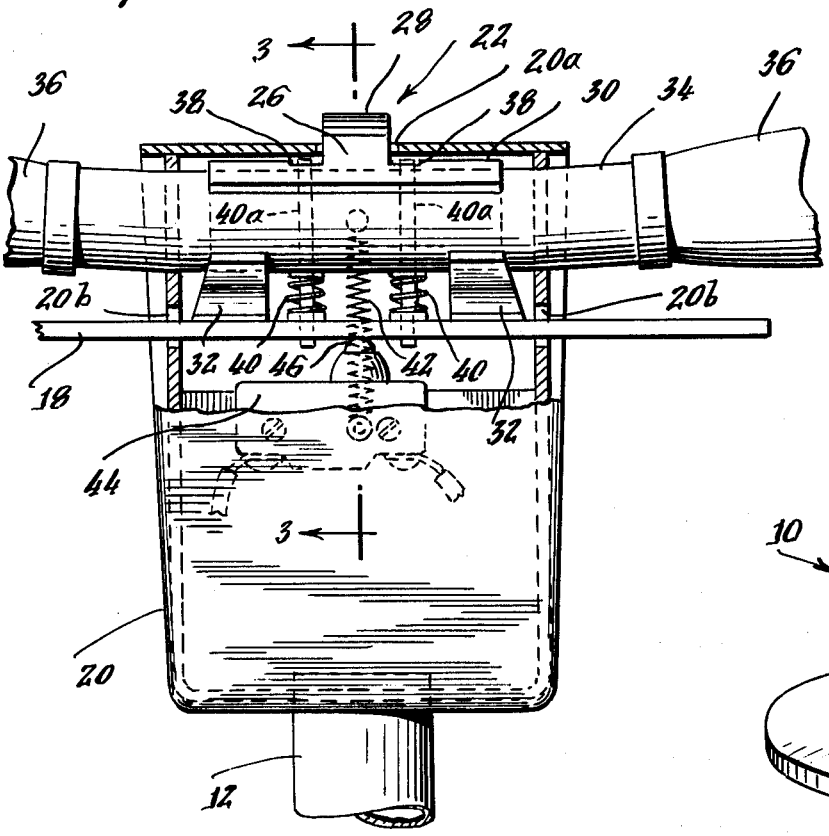
Fig. 1.
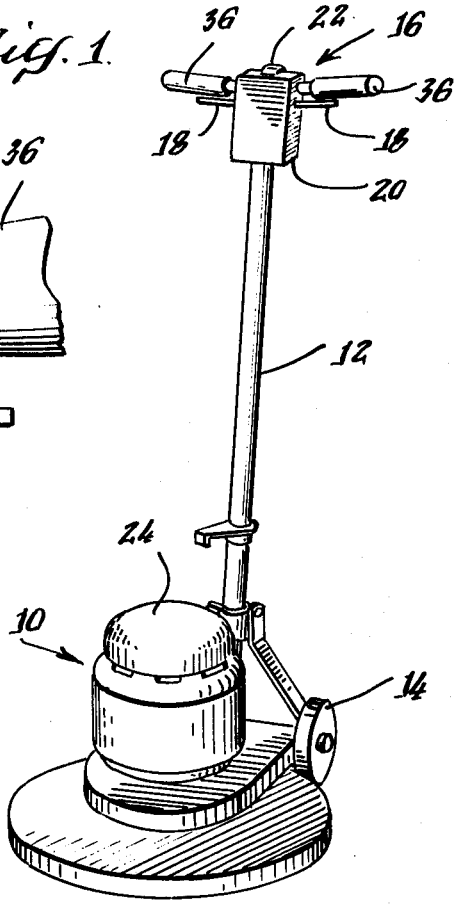
Fig. 3.
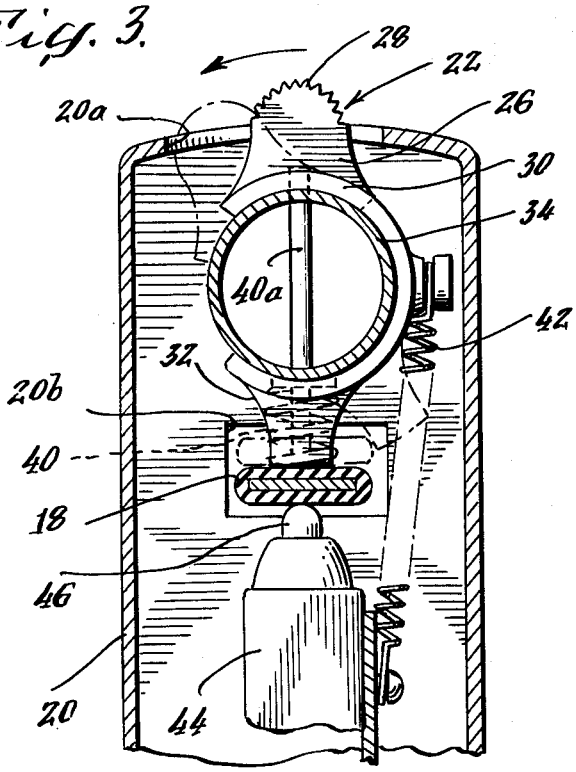
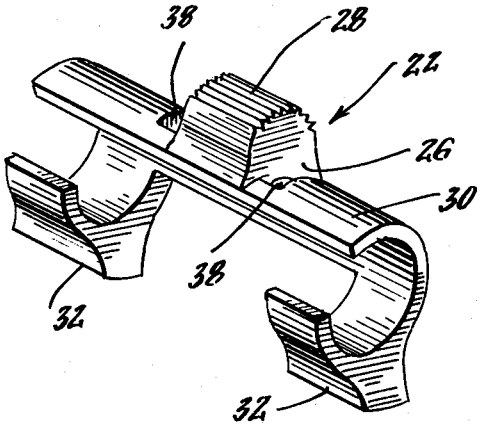
Fig. 4.

SAFETY SWITCH FOR FLOOR TREATMENT APPARATUS

BACKGROUND OF THE INVENTION

Commercial type floor treatment apparatus are known, such as floor polishing machines. These machines, being heavy duty, have a considerable amount of weight and when the machines are on the floor with the handle in a vertical or storage or transportation position with the power cord plugged into the outlet, a safety hazard arises in that the machine can be inadvertently started, either accidentally, or on purpose, by the operation of a trigger mechanism. When this happens the machine often becomes out of control and moves across the floor to injure persons by coming in contact with them. In order to overcome this safety hazard, the present floor treatment machine is provided with a trigger that actuates a negative pressure microswitch adjacent to the handle of the device and a safety switch. Since the trigger mechanism is spring loaded, when it is released, it engages the microswitch to turn the same off. However, starting up of the machine is relatively simple, but may be hazardous. The trigger, which can be activated on both sides of the handle of the machine, together with the handle are merely squeezed, and the machine commences to operate. In order to overcome the above-described hazard, during start-up, an additional manual operation must be performed before the machine can be safely turned on.

It is an object of the present invention to provide a safety switch for a floor treatment apparatus in which the machine operator has to manually rotate the safety switch until the lugs thereon clear the trigger so that the machine is capable of being started from either side of the handle. Thereafter, the operator must keep the trigger actuated because once he releases the trigger, the machine automatically stops, since the microswitch is turned off.

It is another feature of the present invention to provide a safety switch that is in a location adjacent to the handle and trigger elements of the floor treatment apparatus and can be operated by the thumb of the machine operator.

It is a further object of the present invention to provide a novel safety switch for floor treatment apparatus which is relatively inexpensive to manufacture and is reliably effective for the purposes intended.

It is a further object of the present invention to incorporate the present safety switch in the existing control housing of floor treatment apparatus.

In order that the invention will be more clearly understood, it will now be disclosed in greater detail with reference to the accompanying drawings, in which:

FIG. 1 is a perspective view of a commerical floor treatment apparatus incorporating a safety switch constructed in accordance with the teachings of the present invention;

FIG. 2 is an enlarged part front elevation and part sectional view, of the details of the invention;

FIG. 3 is a sectional view taken along the lines of 3—3 of FIG. 2; and

FIG. 4 is an enlarged perpective view of the safety switch in an unmounted state.

DESCRIPTION OF THE PREFERRED EMBODIMENT

FIG. 1 shows a commercial floor treatment apparatus, such as a floor polishing machine 10 having circular brushes (not shown), an upright handle 12, floor engaging wheels 14, and a dual handle grip 16. The machine 10 is also provided with a trigger mechanism 18 in the form of bars which extend on opposite sides from the control housing 20. A safety switch 22 is located on the top of the control housing 20, which can be manually operated by the machine operator. The machine 10 is also provided with a motor 24 for driving the rotatable brushes.

The safety switch which is constructed in accordance with the teachings of the present invention is more clearly seen in FIGS. 2–4 respectively. It is evident that the safety switch 22 is provided with a finger actuated button 26 having serrations 28 thereon. As seen in FIG. 4, the button 26 is integral with the switch body that comprises a generally tubular portion 30, and spaced downwardly projecting lugs 32. The tubular portion 30 is designed to fit around the shaft 34 mounting handle grips 36, and the slots 38 are adapted to receive compression springs 40 that engage the trigger 18 on one end thereof and the safety switch at the other end. A further spring 42 is attached at one end to the safety switch 22 and at the other end to the housing 44 of the microswitch 46.

An opening **20*a* in top surface of housing 20 is elongated so that the safety switch can be pivoted through about an angle of 30° in order to clear the lugs 32 from the trigger 18, as seen in FIG. 3. The full line position shows the lugs 32 of the safety switch blocking the movement of the trigger 18 while the dashed line position shows the lugs 32 beyond the path of movement of the trigger 18** so that the latter can be freely operated by either hand.

It should be noted that spring 42 is a return spring for the safety switch 22, while springs 40 resiliently connect the safety switch to the trigger mechanism. As seen in FIG. 2, the springs 40 are provided with pin guides **42*a* to permit the movement of the trigger toward the handle grip 16** when the safety switch is out of the blocking mode.

Furthermore, the slots **20*b* are large enough to provide the capability of limited movement of the trigger 18 so that the latter can render the microswitch 46** operative or inoperative.

Although a single embodiment of the invention is shown, additional embodiments involving the present concept are possible within the spirit and scope of the invention as set forth in the following claims.

What is claimed is:

1. In a motor-driven floor treatment machine having a control box, a cylindrical dual grip handle passing through said control box, a first switch in said control box for controlling said motor, a trigger extending out of opposite sides of said control box and adjacent to said handle for actuating said first switch, the improvement comprising; a second safety switch movably mounted on said handle and interposed between the latter and said trigger, said safety switch having a blocking means that is a generally tubular body slidably fitting over said cylindrical dual grip handle and having at least one lug normally projecting downwardly from said tubular body, spring means normally biasing said lug into engagement with said trigger when said machine is in an inoperative condition, and finger-actuated means on said tubular body and projecting through an opening in said control box for moving said tubular body to disengage said lug from said trigger against the force of said spring means to permit movement of said trigger to actuate said first switch, said blocking means of the safety switch returning to its normal blocking position by said spring means when said finger-actuated means is released.

2. The safety switch as claimed in claim 1 wherein said finger actuated means is a button having serrations therein extending through said opening in said control box.

3. The safety switch as claimed in claim 2 wherein said button is pivoted in a forward direction in order to simultaneously pivot said blocking means out of the normal path of movement of said trigger.

4. The combination as claimed in claim 1 wherein said first switch is a microswitch having a housing, said spring being connected at one end to said safety switch and at the other end to said housing.

5. The combination as claimed in claim 1 wherein said trigger is in the form of a bar extending laterally from said housing and adjacent to said dual grip handle located above.

* * * * *